US011855354B2

(12) United States Patent
Furukawa et al.

(10) Patent No.: US 11,855,354 B2
(45) Date of Patent: Dec. 26, 2023

(54) MICROSTRIP ANTENNA AND INFORMATION APPARATUS

(71) Applicant: Space Power Technologies Inc., Kyoto (JP)

(72) Inventors: Minoru Furukawa, Kyoto (JP); Zhewang Ma, Saitama (JP)

(73) Assignee: Space Power Technologies Inc., Kyoto (JP)

( * ) Notice: Subject to any disclaimer, the term of this patent is extended or adjusted under 35 U.S.C. 154(b) by 274 days.

(21) Appl. No.: 17/494,237

(22) Filed: Oct. 5, 2021

(65) Prior Publication Data

US 2022/0029306 A1 Jan. 27, 2022

Related U.S. Application Data

(63) Continuation of application No. PCT/JP2020/035353, filed on Sep. 17, 2020.

(30) Foreign Application Priority Data

Nov. 21, 2019 (JP) ..... 2019-210671

(51) Int. Cl.
*H01Q 21/06* (2006.01)
*H01Q 13/08* (2006.01)

(52) U.S. Cl.
CPC ..... *H01Q 21/065* (2013.01); *H01Q 13/08* (2013.01)

(58) Field of Classification Search
CPC .. H01Q 21/065; H01Q 21/0006; H01Q 13/08; H01Q 9/0407; H01Q 9/0442; H01Q 1/38; H01Q 1/50
See application file for complete search history.

(56) References Cited

U.S. PATENT DOCUMENTS 6,211,825 B1 4/2001 Dent
2005/0110680 A1 5/2005 Tanaka et al.
(Continued)

FOREIGN PATENT DOCUMENTS

CA 2383777 A1 3/2001
CN 102956966 A 3/2013
(Continued)

OTHER PUBLICATIONS

International Search Report dated Oct. 13, 2020 in corresponding International Application No. PCT/JP2020/035353; 6 pages.
(Continued)

*Primary Examiner* — Seokjin Kim
(74) *Attorney, Agent, or Firm* — Maier & Maier, PLLC

(57) ABSTRACT

A microstrip antenna corresponds to a rectangular resonator. The resonator has first and second sides being parallel to a first direction and having a length corresponding to 3/2 wavelength, and has a shape notched from each of the first and second sides toward a center of the resonator. The antenna includes: a first portion constituting a periphery of the notched shape; and second and third portions facing each other across the first portion. The notched shape allows the first portion to contribute to a radiation characteristic. The first, second, and third portions each have a length corresponding to 1/2 wavelength in the first direction. The first portion has a width in the second direction that is narrower because of the notched shape than that of the second and third portions. The second or third portion is provided with a feeding point.

6 Claims, 6 Drawing Sheets

(56) References Cited

U.S. PATENT DOCUMENTS

| | | | | |
|---|---|---|---|---|
| 2005/0156787 | A1 | 7/2005 | Myoung et al. | |
| 2006/0244605 | A1 | 11/2006 | Sakama et al. | |
| 2010/0019976 | A1* | 1/2010 | Sakiyama | H01Q 9/0442 343/700 MS |
| 2013/0038492 | A1* | 2/2013 | Abe | H01Q 9/0428 343/700 MS |

FOREIGN PATENT DOCUMENTS

| | | | | |
|---|---|---|---|---|
| CN | 109509963 | A | 3/2019 | |
| CN | 109728431 | A | 5/2019 | |
| DE | 19941311 | C1 | 6/2001 | |
| EP | 4123833 | A1 * | 1/2023 | H01Q 1/36 |
| JP | 2003-258539 | A | 9/2003 | |
| JP | 2003-283241 | A | 10/2003 | |
| JP | 2006-311372 | A | 11/2006 | |
| JP | 2015-159597 | A | 9/2015 | |
| KR | 1020050071968 | A | 7/2005 | |
| KR | 1020070016243 | A | 2/2007 | |
| KR | 1020070058852 | A | 6/2007 | |
| WO | 2008/132785 | A1 | 11/2008 | |

OTHER PUBLICATIONS

Richard E. Hodges et al., "A Deployable High-Gain Antenna Bound for Mars: Developing a new folded-panel reflectarray for the first CubeSat mision to Mars.", IEEE Antennas and Propagation Magazine, Apr. 2017, 40 pages.

Mohamad Kamal A. Rahim et al., "Antenna Array at 2.4 GHz for Wireless LAN system using Point To Point Communication.", 2007 Asia-Pacific Conference On Applied Electromagnetics Proceedings, Oct. 17, 2014, 5 pages.

Jun Numata et al., "FDTD Analysis of Narrow Band Modified Inverted F Antennas", Proceedings of the 2011 IEICE Communications Society Conference 1, Aug. 30, 2011, p. 86, 3 pages.

* cited by examiner

Conventional Example

Conventional Example

MICROSTRIP ANTENNA AND INFORMATION APPARATUS

CROSS-REFERENCE TO RELATED APPLICATIONS

This application is a Continuation Application of No. PCT/JP2020/035353, filed on Sep. 17, 2020, and the PCT application is based upon and claims the benefit of priority from Japanese Patent Application No. 2019-210671, filed on Nov. 21, 2019, the entire contents of which are incorporated herein by reference.

FIELD

The present disclosure relates to microstrip antennas and information apparatuses.

BACKGROUND

Microstrip antennas have been used, for example, in mobile units such as portable telephones, satellite communication apparatuses, and automobiles. Japanese Patent Application Publication No. 2003-258539 and Japanese Patent Application Publication No. 2003-283241 disclose a microstrip antenna.

For antenna performance enhancement, Literatures 1 and 2 below disclose arraying four antennas to increase the antenna gain.

[Literature 1]

Richard E. Hodges, three others, "A Deployable High-Gain Antenna Bound for Mars: Developing a new folded-panel reflectarray for the first CubeSat mission to Mars.", [online], Feb. 21, 2017, IEEE Antennas and Propagation Magazine, Internet (URL: https://www.researchgate.net/publication/315370269_A_Dep loyable_High-Gain_Antenna_Bound_for_Mars_Developing_a_new_fold ed-panel_reflectarray_for_the_first_CubeSat_mission_to_Mars)

[Literature 2]

M K A Rahim, three others, "Antenna array at 2.4 GHz for wireless LAN system using point to point communication", [online], Dec. 4, 2007, IEEE Xplore, Internet (URL: https://www.researchgate.net/publication/4364395_Antenna array_at_24_GHz_for_wireless_LAN_system_using_point_to_point_communication)

Literature 1 discloses a configuration in which four antenna elements are arrayed with a power distribution unit. In the technique of Literature 1, a substrate material and thickness suitable for a surface to place an antenna on are different from those for a surface to place a circuit on. Therefore, to obtain a high gain, the antenna and the circuit have been formed by different substrates.

Literature 2 discloses forming a circuit such as a power distribution unit on the antenna side. This, however, makes the antenna trade off the radiation efficiency.

DETAILED DESCRIPTION

A microstrip antenna according to an aspect of the present disclosure corresponds to a rectangular resonator having:

- a first side and a second side being parallel to a first direction and having a length corresponding to 3/2 wavelength; and
- a third side and a fourth side being parallel to a second direction orthogonal to the first direction, the rectangular resonator having a shape notched from each of the first side and the second side toward a center of the rectangular resonator, the microstrip antenna including:

- a first portion constituting a periphery of the notched shape; and
- a second portion and a third portion facing each other across the first portion,
- the notched shape allowing the first portion to contribute to a radiation characteristic for the second portion and the third portion,
- the first portion, the second portion, and the third portion each having a length corresponding to ½ wavelength in the first direction,
- the first portion having a width in the second direction that is narrower because of the notched shape than a width of the second portion and the third portion in the second direction, and
- either the second portion or the third portion being provided with a feeding point.

An embodiment will be described below with reference to the drawings. Note that, hereinafter, elements the same as or similar to those already described will be denoted by the same or similar reference signs, and redundant description thereof will be basically omitted. For example, for a plurality of identical or similar elements, a common reference sign may be used to describe the elements without distinction therebetween, or a suffix number may be used in addition to the common reference sign to describe the elements with distinction therebetween.

Comparative Example

First, as a comparison target, the configuration of a conventional microstrip antenna 10 will be described.

Figure 1A:
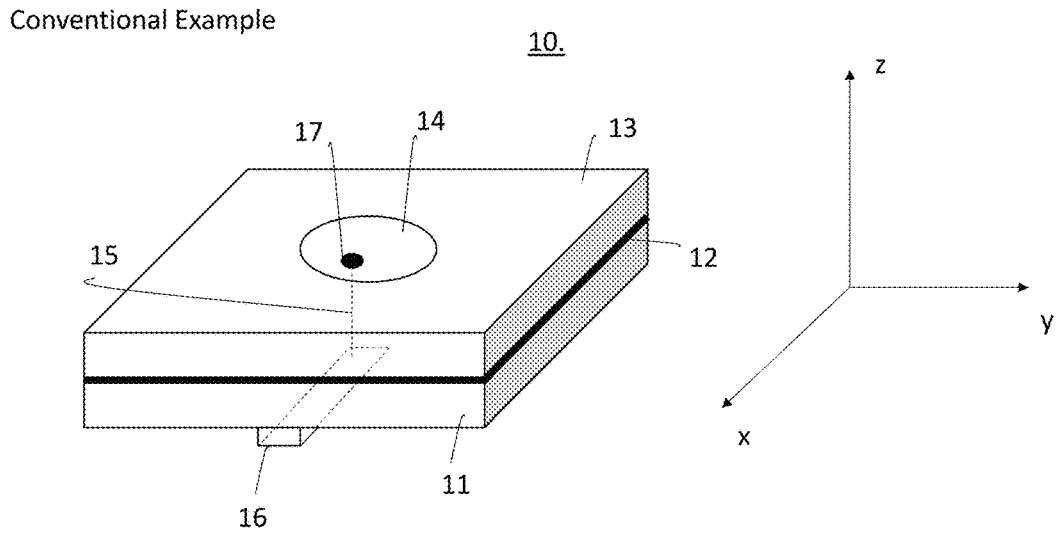
FIG. 1A shows a configuration of a conventional microstrip antenna.

FIGS. 1A, 1B, 1C, and 1D are views of configurations of conventional microstrip antennas. As shown in FIG. 1A, the microstrip antenna 10 includes a feed circuit substrate 11, a ground plane (ground conductor plane) 12, an antenna substrate (dielectric substrate) 13, a microstrip patch 14, a feed pin 15, and a feed conductor 16.

In FIG. 1A, the plane in which the antenna substrate 13 or the like has the microstrip patch 14 is taken as a plane defined by x- and y-axes, and the direction orthogonal to the x- and y-axes is taken as z-axis. That is, the z-axis indicates thickness direction of the microstrip antenna 10.

The feed circuit substrate 11 includes the feed conductor 16. The feed conductor 16 is configured to feed the feed pin 15. The feed conductor 16, together with the ground plane 12, forms a microstrip line. The microstrip line is a line for transmitting power.

The ground plane 12 is an electric conductor and is provided between the antenna substrate 13 and the feed circuit substrate 11.

The antenna substrate 13 includes the microstrip patch 14 on its upper surface.

The microstrip patch 14 is fed with power by the feed pin 15. The feed pin 15 is joined to the microstrip patch 14 by a feeding point 17 and feeds the microstrip patch 14 through the feeding point 17.

The microstrip patch 14, together with the ground plane 12, forms the microstrip antenna. The microstrip antenna radiates radio waves. The microstrip patch 14 may also be referred to as a radiating element.

The feed conductor 16 feeds the feed pin 15 with power.

Figure 1B:
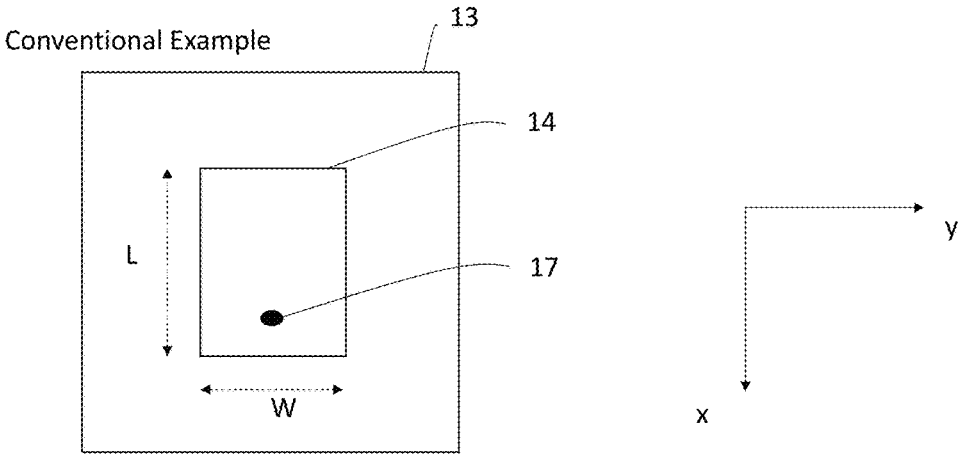
FIG. 1B shows a configuration of a conventional microstrip antenna.

Note that in the example as illustrated, the microstrip patch 14 takes the shape of a circle or of an ellipse but may be rectangular. FIG. 1B shows an example of the microstrip patch 14 having a rectangular shape.

As shown in FIG. 1B, the rectangular microstrip antenna has a structure equivalent to that of a microstrip line having length "L" and width "W" and operates as a resonator.

Figure 1C:
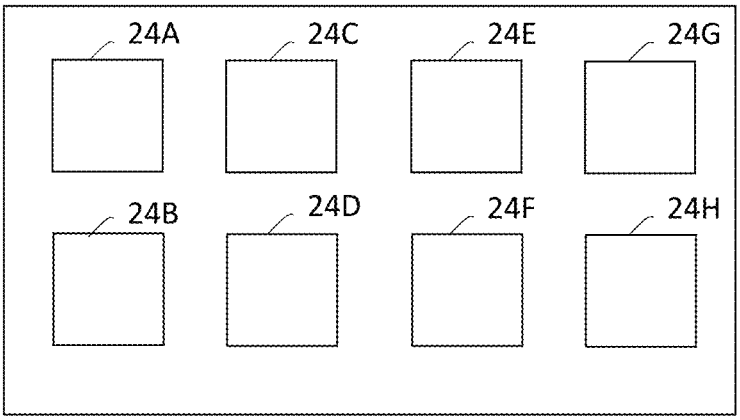
FIG. 1C shows a configuration of a conventional microstrip antenna.

As shown in FIG. 1C, antenna elements are arrayed with a power distribution unit in some configurations. In FIG. 1C, antenna elements 24 (24A to 24H) are arranged on the antenna side. The four antenna elements 24A, 24B, 24C, and 24D are arrayed. The four antenna elements 24E, 24F, 24G, and 24H are also arrayed.

Figure 1D:
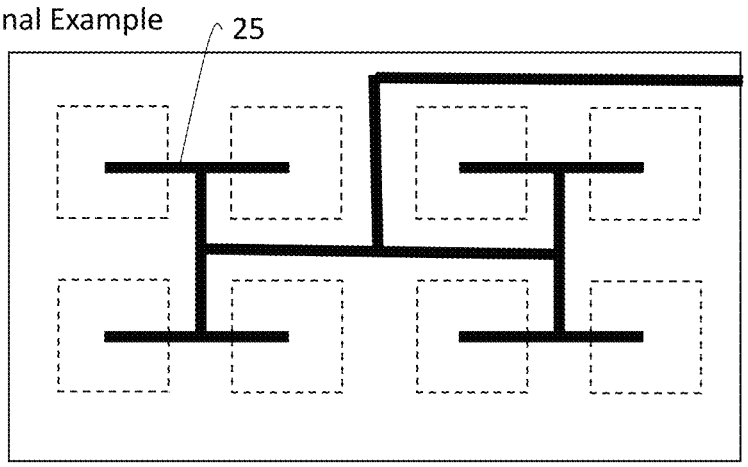
FIG. 1D shows a configuration of a conventional microstrip antenna.

FIG. 1D shows the substrate surface on which the power distribution unit 25 is placed. FIG. 1D corresponds to FIG. 1C, and the positions where the antenna elements 24 are arranged in FIG. 1C are indicated by dotted lines in FIG. 1D.

In the examples shown in FIGS. 1C and 1D, when the power distribution unit 25 is placed on the antenna side (FIG. 1D), a region for placing the power distribution unit 25 needs to be provided on the antenna side, and the radiation efficiency of the antenna thus will be reduced as compared with the case of FIG. 1C.

As described above, arraying the antenna elements 24 involves use of the power distribution unit 25, and the loss due to such use will reduce the radiation efficiency of the antenna.

If the antenna side and the circuit side for placing the power distribution unit 25 are formed of their respective different substrates, the area occupied by the power distribution unit would be relatively large (the area occupancy rate would be high), which may restrict the area for forming other circuits in the substrate to place the power distribution unit on.

<Description of a Microstrip Antenna According to an Embodiment>

FIGS. 2A, 2B, 2C, and 2D are views of microstrip antennas according to an embodiment.

Figure 2A:
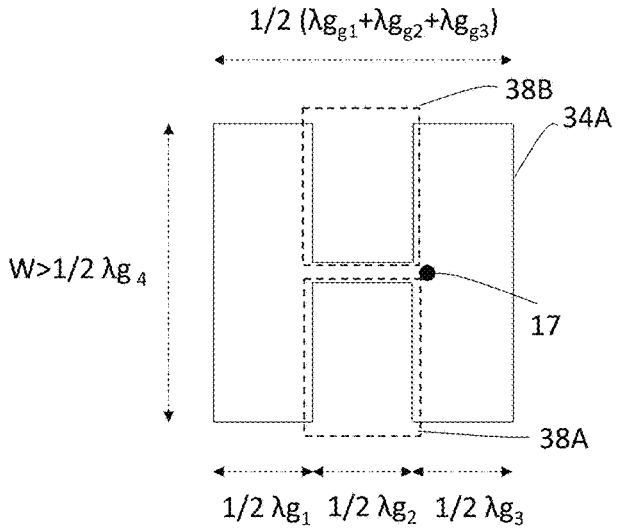
FIG. 2A is a view of microstrip antennas according to an embodiment.

FIG. 2A shows an example shape of the microstrip antenna according to the embodiment. As illustrated, a microstrip patch 34A is H-shaped.

The microstrip patch 34A is configured as a rectangular resonator having a predetermined wavelength. Here, as illustrated, the microstrip patch 34A is configured as the rectangular resonator having 3/2 effective wavelength (hereinafter referred to as wavelength) as the predetermined wavelength. A microstrip line takes various effective wavelengths because an effective permittivity changes according to its characteristic impedance. That is, the effective wavelength is determined based on a variable; accordingly, a width of the microstrip patch 34A is described, for example, as "$\lambda g$".

The microstrip patch 34A in the illustrated example has a width of 3/2 wavelength in a lateral direction, thereby operating as a resonator. As illustrated, a width (length in the lateral direction in the illustrated example) of notches 38A and 38B is defined as "$\frac{1}{2}\lambda g_2$".

In the microstrip patch 34A, a region between the notches 38A and 38B is defined as a first portion (a first portion 39A corresponding to a narrow part of the H-shaped form as will be described later for FIG. 3A).

Figure 3A:
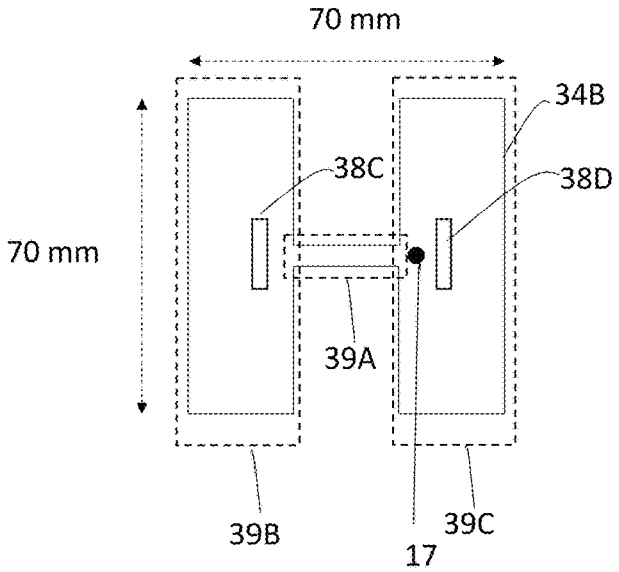
FIG. 3A is a diagram showing conditions for operation comparison.

In the microstrip patch 34A, two regions facing the first portion are defined as a second portion and a third portion (a second portion 39B and a third portion 39C as shown in FIG. 3A). A width of the second portion 39B is defined as "$\frac{1}{2}\lambda g_1$". A width of the third portion 39C is defined as "$\frac{1}{2}\lambda g_3$".

As described above, the width (length in the lateral direction in the illustrated example) of the microstrip patch 34A is represented as $\frac{1}{2}(\lambda g_1+\lambda g_2+\lambda g_3)$, and the width of the microstrip patch 34A is defined as 3/2 wavelength as stated above.

In the microstrip patch 34A, the length in the longitudinal direction (length "W" in the illustrated example) takes any value of 1/2 effective wavelength or more. The illustrated example shows the length "W" to be "$\frac{1}{2}\lambda g_4$" or more.

The microstrip patch 34A has such a shape as notched by the notches 38A and 38B. The notches 38A and 38B have a width (length in the lateral direction in the illustrated example) having a length based on a predetermined wavelength. A length (width) of a side of the notches 38A and 38B is made a width of 1/2 wavelength as the length based on the predetermined wavelength. By having the shape notched by the notches 38A and 38B, the microstrip patch 34A is shaped to have a narrow part of the H-shaped form (i.e., a part between the notches 38A and 38B).

The microstrip patch 34A includes a feeding point 17 at a position other than the narrow part of the H-shaped form. As illustrated, the microstrip patch 34A has the feeding point 17 at any position in two regions facing each other across the narrow part in the H-shaped form. The region has a side of 3/2 wavelength and a side of 1/2 or more wavelength.

As described above, compared with a rectangular resonator without the notches 38A and 38B, the rectangular resonator (without notch) upon being fed from the feeding point will display three current peaks of the same intensity linearly for every 1/2 wavelength, as a 3/2 wavelength resonator. At this time, the central 1/2 wavelength portion has the current opposite in phase to that of the two facing regions, and thus does not contribute to the radiation in the z-direction (front direction), resulting in a sidelobe component. On the other hand, the microstrip patch 34A upon being fed through the feeding point 17 will have a smaller current flowing in the narrow part of the H-shaped form due to the notches 38A and 38B than in the two facing regions (the characteristic impedance is higher and the current is less likely to flow as compared with the rectangular resonator without notch); that is, the sidelobe level can be made lower in the narrow part as a radiation characteristic of the microstrip antenna.

Note that the narrow part may be shielded by metal in order to further lower the sidelobe level.

Further, the narrow part may have a thickness (in the z-axis direction) smaller than that of the two regions facing the narrow part.

As described above, the microstrip patch 34A includes the rectangular resonator having the notched shape (notches 38A, 38B) and the notched shape allows the first portion constituting a periphery of the notched shape (the narrow part between the notches 38A and 38B; the first portion 39A of FIG. 3A described later) to contribute to the radiation characteristic for the second portion (second portion 39B of FIG. 3A described later) and the third portion (third portion 39C of FIG. 3A described later) facing each other across the first portion.

Figure 2B:
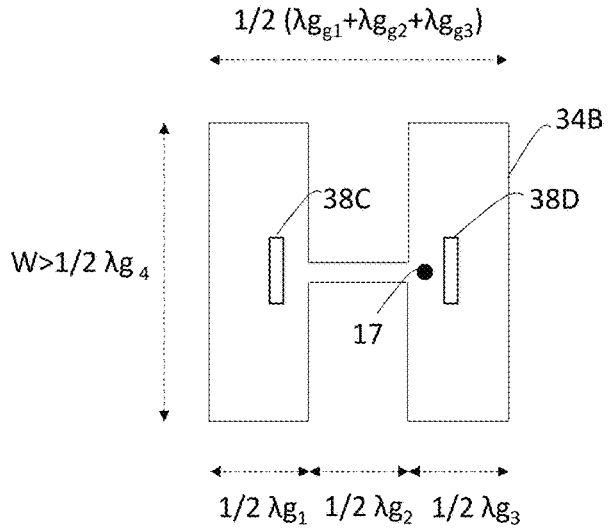
FIG. 2B is a view of microstrip antennas according to an embodiment.

FIG. 2B shows another example shape of the microstrip antenna according to the embodiment. As illustrated, microstrip patch 34B is shaped such that the two regions facing each other with the narrow part of the H-shaped form interposed therebetween are cut out by slots 38C and 38D, as compared with the microstrip patch 34A of FIG. 2A. Either of the slots 38C and 38D is provided in the vicinity of the feeding point 17. As illustrated, the microstrip patch 34B is formed to have the slot 38D in the vicinity of the feeding point 17. In the microstrip patch 34B, the number of parts cut out from the above two regions is set to two, but is not limited to two.

Figure 2C:
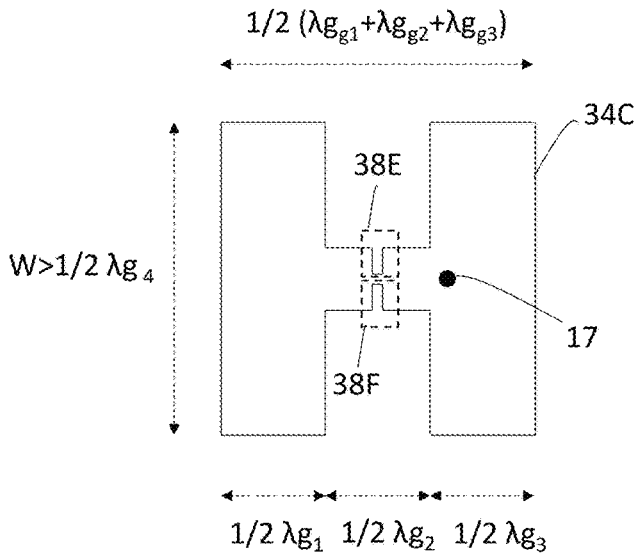
FIG. 2C is a view of microstrip antennas according to an embodiment.

FIG. 2C shows another example shape of the microstrip antenna according to the embodiment. As illustrated, microstrip patch 34C is shaped such that the narrow part of the H-shaped form is further notched from its outside by notches 38E and 38F, as compared with the microstrip patch 34A of FIG. 2A. That is, the microstrip patch 34C upon being fed through the feeding point 17 will have a current flowing in the part interposed between the notches 38E and 38F (a further narrower part of the narrow part of the H-shaped form in the microstrip patch 34C) (the current is less likely to flow as compared to the rectangular resonator without notch). In the illustrated example, the narrow part of the H-shaped form of the microstrip patch 34C is formed to be thicker than that of the microstrip patch 34A. In the microstrip patch 34C, the number of parts notched from outside the narrow part is set to two, but is not limited to two.

Figure 2D:
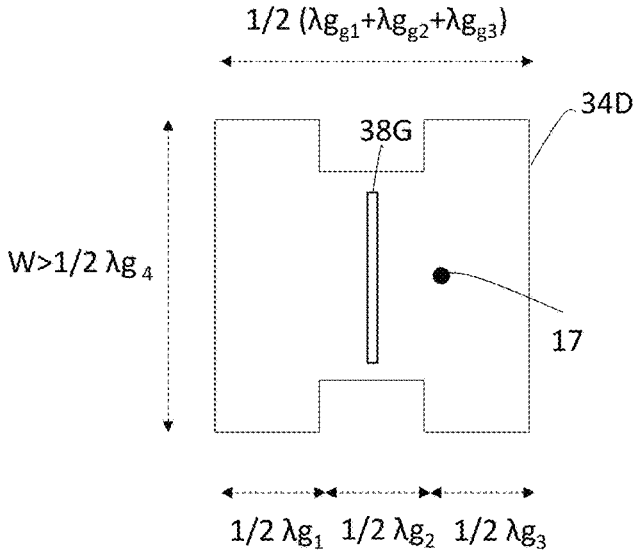
FIG. 2D is a view of microstrip antennas according to an embodiment.

FIG. 2D shows another example shape of the microstrip antenna according to the embodiment. As illustrated, microstrip patch 34D is shaped such that the narrow part of the H-shaped form has its inside cut by slot 38G, as compared with the narrow part of the microstrip patch 34A of FIG. 2A. That is, the microstrip patch 34D upon being fed through the feeding point 17 will have a current bypassing the slot 38G. By the current bypassing as well as having its phase inverted on the left and right of the slot, the sidelobe level can be further lowered. In the microstrip patch 34D, the number of parts cut out from inside the narrow part is set to one, but is not limited to one.

<Operation Comparison>

A description will be given of a result of comparing operations between the microstrip patch 34B described in the embodiment and the antenna array described as the conventional example.

Figure 3B:
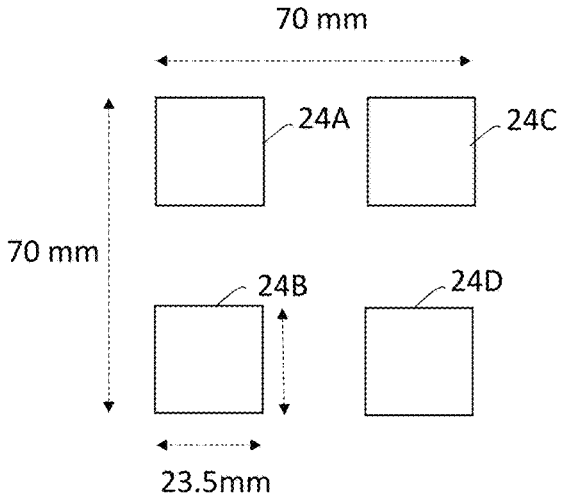
FIG. 3B is a diagram showing conditions for operation comparison.

FIGS. 3A and 3B are diagrams showing conditions for the operation comparison. FIG. 3A shows the shape and dimensions of the microstrip antenna 34B according to the embodiment. FIG. 3B shows the shape and dimensions of the antenna array described with reference to FIGS. 1C and 1D as the comparative example. As described above, the microstrip patch 34B includes the first portion 39A that is the narrow part of the H-shaped form, and the second portion 39B and the third portion 39C facing each other across the narrow part.

As shown in FIGS. 3A and 3B, the microstrip patch 34B is of the same size as the antenna array with the antenna elements 24A, 24B, 24C, and 24D. To be more specific, the microstrip patch 34B is dimensioned to have a side with a width of "70 mm". That is, the microstrip patch 34B shown in the example of FIG. 3A has the width (the length in the lateral direction in the illustrated example) equal to the length "W" (length in the longitudinal direction in the illustrated example). When the length "W" is changed (when the length "W" is increased), the gain will increase despite of the occurrence of unnecessary resonance as compared to the gain before the change, which sometimes enhances the radiation efficiency of the microstrip patch 34.

On the other hand, the antenna array has the antenna elements 24A, 24B, 24C, and 24D each dimensioned to have a width of "23.5 mm", and is dimensioned as a whole to have a side with a width of "70 mm" by the arrangement of these antenna elements 24A, 24B, 24C, and 24D.

That is, the microstrip patch 34B has substantially the same footprint as the antenna array when placed on a substrate.

Figure 4A:
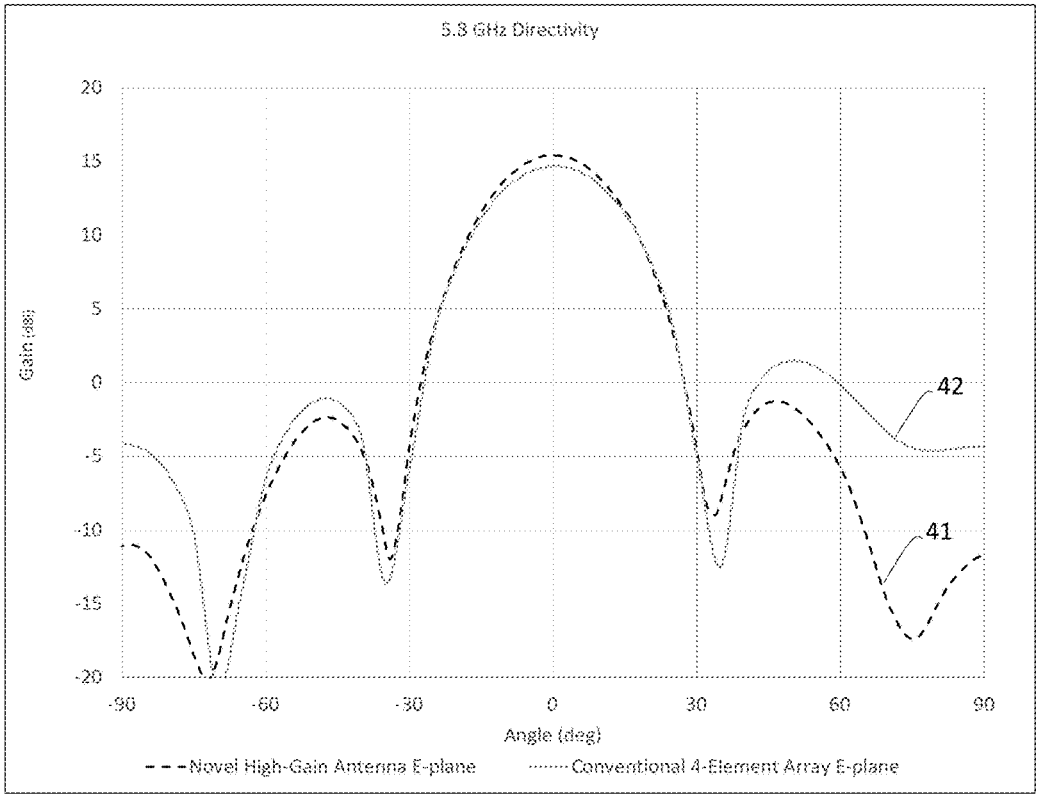
FIG. 4A is a graph showing results of comparing antenna radiation directivities.
Figure 4B:
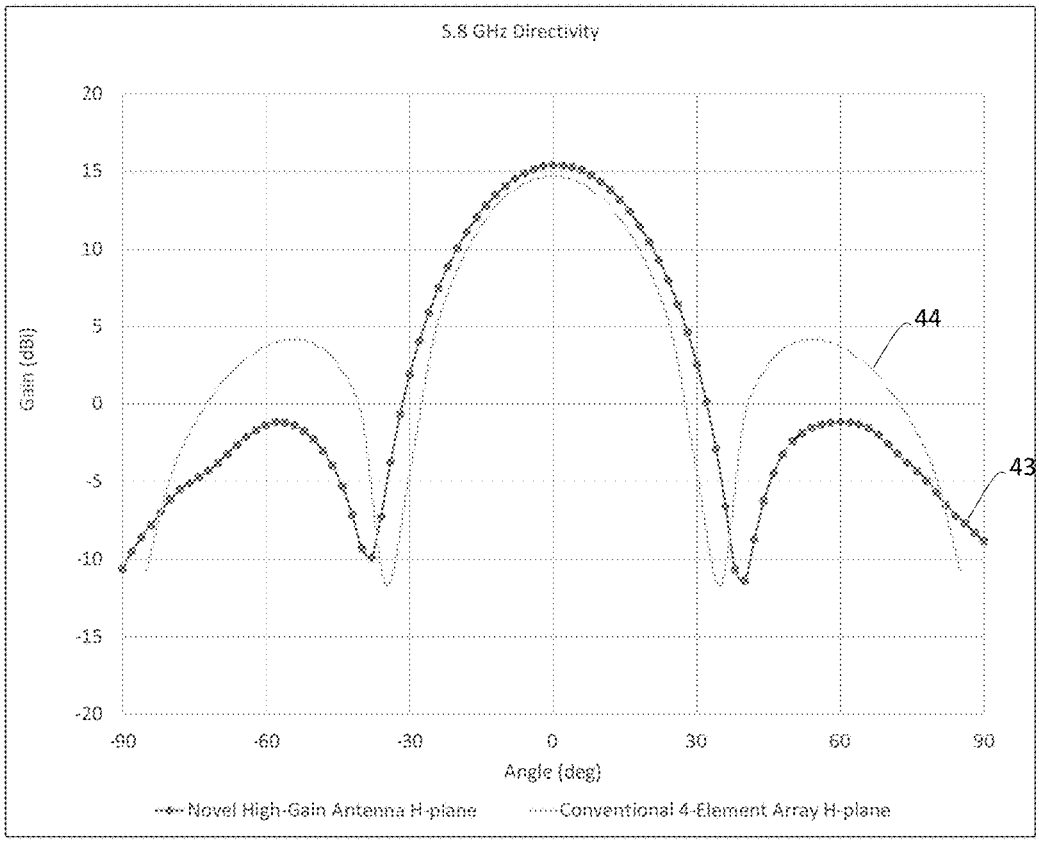
FIG. 4B is a graph showing results of comparing antenna radiation directivities.

FIGS. 4A, and 4B are graphs showing results of comparing antenna radiation directivities.

As an example shown in FIGS. 4A, and 4B, the result of comparing operations based on 5.8 GHz signal is shown. For the microstrip patch 34B, the radiation directivity is actually measured, and the graph is drawn based on the measured value. For the antenna array described as the conventional example, the graph is drawn based on a calculated value from an electromagnetic field simulation.

As a result of comparing the above, (1) for the gain, the microstrip patch 34B, which requires no power distribution unit (power distribution unit 25), is about 15% more efficient than the conventional antenna array.

Specifically, when the microstrip patch 34B is compared with the antenna array of the conventional example, the plurality of antenna elements 24A, 24B, 24C, and 24D of the antenna array of the conventional example have a gain comparable to that of the microstrip patch 34B. For example, on the conditions that the relative dielectric constant is "1" and the thickness of the substrate to place the antenna array on is "1 mm", both the microstrip patch 34B and the antenna elements 24A, 24B, 24C, and 24D have a gain of about 15.4 (dBi).

On the other hand, the loss due to the placement of the power distribution unit (power distribution unit 25) in the antenna array will be 0.7 (dB) on the conditions that the relative dielectric constant is "3.2" and the thickness of the substrate to place the power distribution unit on is "0.8 mm".

From the above, when the effective gains are compared between the antenna array with the loss due to the power distribution unit considered and the microstrip patch 34B, the microstrip patch 34B has an effective gain of 15.4 (dBi), whereas the antenna array of the conventional example has an effective gain of 14.7 (dBi) (i.e., "15.4"−"0.7"), and the microstrip patch 34B is about 15% (0.7 dB) more efficient than the antenna array of the conventional example.

In addition, (2) for the radiation directivity, the microstrip patch 34B has a lower sidelobe and excellent interference resistance as compared with the antenna array of the conventional example.

For example, for the radiation directivity, the microstrip patch 34B has a sidelobe level of "−16.7" (dB) for E-plane in the direction of "±50°" as an elevation angle with respect to the axis (z-axis) orthogonal to the plane of the substrate on which the microstrip patch 34B or the antenna array of the conventional example is placed, whereas the antenna array of the conventional example is evaluated to have a sidelobe level of "−13.2" (dB); the microstrip patch 34B has a lower sidelobe level by 3 (dB) or more.

For example, for the radiation directivity, the microstrip patch 34B has a sidelobe level of "−16" (dB) for H-plane in the direction of "±55°" as an elevation angle with respect to the z-axis, whereas the antenna array of the conventional example is evaluated to have a sidelobe level of "−10.5" (dB); the microstrip patch 34B has a lower sidelobe level by 6 (dB) or more.

To explain in detail below, FIG. 4A is a graph in which the E-plane directivity properties are compared between the microstrip patch 34B and the antenna array described as the conventional example. In FIG. 4A, radiation directivity 41 of the microstrip patch 34B is indicated by a dotted line, and radiation directivity 42 of the antenna array described as the conventional example is indicated by a solid line.

FIG. 4B is a graph in which the H-plane directivity properties are compared between the microstrip patch 34B and the antenna array described as the conventional example. In FIG. 4B, radiation directivity 43 of the microstrip patch 34B is indicated by a solid line with a bullet (symbol "●") for each measurement point, and radiation directivity 44 of the antenna array described as the conventional example is indicated by a solid line without bullet.

In FIGS. 4A and 4B, the radiation directivity 41 of the microstrip patch 34B is labeled "Novel High-Gain Antenna", and the radiation directivity 42 of the antenna array described as the conventional example is labeled "Conventional 4-Element Array". Further, in FIGS. 4A and 4B, the horizontal axis indicates an elevation angle with respect to the axis (z-axis) orthogonal to the plane of the substrate on which the microstrip patch 34B or the antenna array is placed. The vertical axis indicates a gain.

As shown in FIGS. 4A and 4B, in the vicinity of the elevation angle "±0°" with respect to the z-axis, the radiation directivity 41 (microstrip patch 34B) attains a more efficient gain than the radiation directivity 42 (the antenna array of the conventional example), and the radiation directivity 43 (microstrip patch 34B) attains a more efficient gain than the radiation directivity 44 (the antenna array of the conventional example).

Also, as for the sidelobe level (for example, in the vicinity of the elevation angle "±50°", "±55°"), the radiation directivity 41 is lower than the radiation directivity 42, and the radiation directivity 43 is lower than the radiation directivity 44.

From the above, it can be said that the microstrip antenna of the present embodiment has higher radiation efficiency despite the fact that its antenna area is substantially the same as that of the conventional example.

Compared with the conventional example, the microstrip antenna described in the embodiment is in no need of the provision of a power distribution unit (synthesizer), and thus can eliminate the loss due to the power distribution unit and attain enhanced radiation efficiency. In addition, since it is possible to eliminate the need for a substrate for the power distribution unit, the production is facilitated. Further, when a circuit is formed on the reverse side of the surface to place an antenna, it is possible to use a wide area on the reverse side to form a desired circuit because no power distribution unit needs to be provided.

The microstrip antenna described above can be mounted on various information apparatuses, for example, mobile units such as portable telephones, satellite communication apparatuses, and automobiles. In other words, the information apparatus includes the microstrip antenna (microstrip patch 34A, 34B, 34C, 34D) described in the above embodiment. The information apparatus may be configured to supply power to another device by radiating power through the microstrip patch 34A or the like. That is, the information apparatus may be a wireless power transmission apparatus for transmitting power wirelessly.

The invention claimed is:

1. A microstrip antenna corresponding to a rectangular resonator, the rectangular resonator having:

a first side and a second side being parallel to a first direction and having a length corresponding to ⅗ wavelength; and a third side and a fourth side being parallel to a second direction orthogonal to the first direction, the rectangular resonator having a shape notched from each of the first side and the second side toward a center of the rectangular resonator, the microstrip antenna comprising:

a first portion constituting a periphery of the notched shape; and a second portion and a third portion facing each other across the first portion, the notched shape allowing the first portion to contribute to a radiation characteristic for the second portion and the third portion, the first portion, the second portion, and the third portion each having a length corresponding to ½ wavelength in the first direction, the first portion having a width in the second direction that is narrower because of the notched shape than a width of the second portion and the third portion in the second direction, and either the second portion or the third portion being provided with a feeding point.

2. The microstrip antenna according to claim 1, wherein as the notched shape, the rectangular resonator has a rectangular notch having a length of ½ wavelength in the first direction from the first side and a rectangle notch having a length of ½ wavelength in the first direction from the second side, thereby being H-shaped.

3. The microstrip antenna according to claim 1, wherein part of an inside of at least one of the second portion or the third portion is cut out.

4. The microstrip antenna according to claim 1, wherein the first portion has a width variable in the second direction because of the notched shape.

5. The microstrip antenna according to claim 1, wherein part of an inside of the first portion is cut out.

6. An information apparatus comprising the microstrip antenna according to claim 1.

* * * * *